US011387587B1

(12) United States Patent
Ramsey

(10) Patent No.: US 11,387,587 B1
(45) Date of Patent: Jul. 12, 2022

(54) SELF-RETAINED SLIDER CONTACT PIN

(71) Applicant: PLASTRONICS SOCKET PARTNERS, LTD., Irving, TX (US)

(72) Inventor: James M Ramsey, Frisco, TX (US)

(73) Assignee: PLASTRONICS SOCKET PARTNERS, LTD., Irving, TX (US)

( * ) Notice: Subject to any disclaimer, the term of this patent is extended or adjusted under 35 U.S.C. 154(b) by 0 days.

(21) Appl. No.: 17/200,798

(22) Filed: Mar. 13, 2021

(51) Int. Cl.
*H01R 13/24* (2006.01)

(52) U.S. Cl.
CPC ..... *H01R 13/2421* (2013.01)

(58) Field of Classification Search
CPC ..... H01R 13/2421
USPC ..... 439/66, 700
See application file for complete search history.

(56) References Cited

U.S. PATENT DOCUMENTS 6,506,082 B1 * 1/2003 Meek ..... H01R 13/2421 439/700
7,025,602 B1 * 4/2006 Hwang ..... H01R 12/714 439/66
7,467,952 B2 * 12/2008 Hsiao ..... H01R 13/2421 439/700
7,520,754 B1 4/2009 Gattuso
7,841,864 B2 * 11/2010 Hsiao ..... H01R 13/2421 439/66
8,231,416 B2 * 7/2012 Johnston ..... H01R 13/2421 439/700
8,262,419 B2 * 9/2012 Chen ..... H01R 13/2421 439/700
8,373,430 B1 * 2/2013 Sochor ..... H01R 13/2421 324/755.05
8,435,046 B2 * 5/2013 Gattuso ..... H01R 12/714 439/71
8,690,587 B2 * 4/2014 Ishikawa ..... H01R 13/2421 439/66

(Continued)

FOREIGN PATENT DOCUMENTS

KR 102126753 6/2020
KW 100878346 B1 1/2009

(Continued)

OTHER PUBLICATIONS

Patent Translate, EPO and Google, Machine translation for KR100878346B1, Dec. 23, 2020 translate.

(Continued)

*Primary Examiner* — Neil Abrams
(74) *Attorney, Agent, or Firm* — Guy V. Manning

(57) ABSTRACT

A self-retained slider contact pin has a first contact which is coined to form a first notch and a first finger, and a second notch and a second finger. The first finger and the second finger extend longitudinally relative to the first contact and generally parallel to the first notch and the second notch. A second contact is coined to form an opening and a first channel, and a second opening and a second channel. The first contact and the second contact inter-fit in alignment with the first finger extending through the opening and into the first channel and the second finger extending through the second opening and into the second channel, such that the first finger and the second finger retain together in sliding engagement the first contact and the second contact. A bias spring pushes apart the first contact and the second contact.

16 Claims, 5 Drawing Sheets

(56) References Cited

U.S. PATENT DOCUMENTS

| | | | | |
|---|---|---|---|---|
| 8,715,015 | B2 | 5/2014 | Hwang | |
| 8,808,037 | B2 * | 8/2014 | Park | H01R 12/714 439/700 |
| 9,088,083 | B2 | 7/2015 | Mason et al. | |
| 9,190,749 | B2 * | 11/2015 | Chen | H01R 12/714 |
| 9,595,773 | B2 * | 3/2017 | Hemmi | H01R 13/2471 |
| 9,797,925 | B2 * | 10/2017 | Teranishi | G01R 1/06738 |
| 9,829,506 | B2 * | 11/2017 | Treibergs | G01R 1/0416 |
| 10,145,862 | B2 | 12/2018 | Teranishi et al. | |
| 10,557,867 | B2 | 2/2020 | Teranishi et al. | |
| 11,187,722 | B2 * | 11/2021 | Teranishi | G01R 1/067 |
| 11,196,204 | B2 * | 12/2021 | Schwarz | H01R 24/50 |
| 2009/0093171 | A1 | 4/2009 | Ju | |
| 2017/0138985 | A1 | 5/2017 | Teranishi et al. | |
| 2020/0158753 | A1 | 5/2020 | Teranishi et al. | |

FOREIGN PATENT DOCUMENTS

| | | |
|---|---|---|
| WO | WO2016147691 | 9/2016 |
| WO | WO2017047362 | 3/2017 |

OTHER PUBLICATIONS

Patent Translate, EPO and Google, Machine translation for KR102126753B1, Dec. 23, 202.
Patent Translate, EPO and Google, Machine translation for WO2016147691A1, Dec. 23, 2020.
Patent Translate, EPO and Google, Machine translation for WO2017047362A1, Dec. 23, 2020.

* cited by examiner

SELF-RETAINED SLIDER CONTACT PIN

TECHNICAL FIELD OF THE INVENTION

The present invention relates in general to a contact pin for electronic devices for providing a self-retained and compliant contact pin for connecting between electric circuits.

BACKGROUND OF THE INVENTION

Compliant contact pins and spring probes have long been provided for connecting between electric circuits in electronic devices such as those used in connectors, and in test and burn-in sockets. Spring contact pins have included those which are not self-retaining but are instead captured within apertures of a socket or a connector. Other spring biased contact pins have been self-retaining, that is, mating contacts of the contact pins are held together by interaction of the respective pins, such as pogo pins formed of extruded contacts which are held together by crimping and H-pins formed of stamped contacts which are held together by tabs from one set of contacts which extend within slots formed in mating contacts. When used with high frequency circuits it is important that the contact pins not introduce inductance, capacitance, and other unwanted impedance which may occur with compliant sliding point contacts under mechanical loads.

SUMMARY OF THE INVENTION

A self-retained slider contact pin is disclosed which has a first contact which is coined to form a first notch and a first finger, and a second notch and a second finger. The first finger and the second finger extend longitudinally relative to the first contact and generally parallel to the first notch and the second notch. A second contact is coined to form an opening and a first channel, and a second opening and a second channel. The first contact and the second contact inter-fit in alignment with the first finger extending through the opening and into the first channel and the second finger extending through the second opening and into the second channel, such that the first finger and the second finger retain together in sliding engagement the first contact and the second contact. A bias spring pushes apart the first contact and the second contact.

DESCRIPTION OF THE DRAWINGS

For a more complete understanding of the present invention and the advantages thereof, reference is now made to the following description taken in conjunction with the accompanying Drawings in which

FIG. 1 is a perspective view of a self-retained slider contact pin;

FIG. 2 is a sectional view of the self-retained slider contact pin, taken along section line 2-2 of FIG. 1;

FIG. 3 is a perspective view of part of the self-retained slider contact pin, showing a first contact engaged with a second contact;

FIG. 4 is an exploded view of the first contact separated from the second contact;

FIG. 5 is a perspective view of a second self-retained slider contact pin;

FIG. 6 is a sectional view of the second self-retained slider contact pin, taken along section line 6-6 of FIG. 5;

FIG. 7 is a perspective view of part of the second self-retained slider contact pin, showing a first contact engaged with a second contact;

FIG. 8 is an exploded view of part of the second self-retained slider contact pin, showing first contact separated from the second contact;

FIG. 9 is a perspective view of a third self-retained slider contact pin;

FIG. 10 is a sectional view of part of the third self-retained slider contact pin, taken along section line 10-10 of FIG. 9;

FIG. 11 is a perspective view of part of the third self-retained slider contact pin, showing a first contact engaged with a second contact;

FIG. 12 is an exploded view of part of the third self-retained slider contact pin, showing first contact separated from the second contact;

FIG. 13 is a perspective view of a fourth self-retained slider contact pin;

FIG. 14 is a sectional view of part of the fourth self-retained slider contact pin, taken along section line 14-14 of FIG. 13;

FIG. 15 is a perspective view of part of the fourth self-retained slider contact pin, showing a first contact engaged with a second contact;

FIG. 16 is an exploded view of part of the fourth self-retained slider contact pin, showing first contact separated from the second contact; and FIG. 17 is a perspective view of a fifth self-retained slider contact pin;

FIG. 18 is a sectional view of part of the fifth self-retained slider contact pin, taken along section line 18-18 of FIG. 17;

FIG. 19 is a perspective view of part of the fifth self-retained slider contact pin, showing a first contact engaged with a second contact; and FIG. 20 is an exploded view of part of the fifth self-retained slider contact pin, showing first contact separated from the second contact.

DETAILED DESCRIPTION OF THE INVENTION

Figure 1:
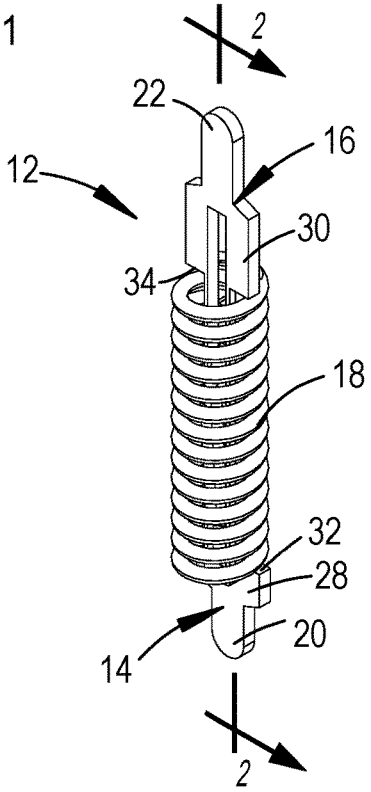
FIGS. 1 through 20 show various aspects for self-retained slider contact pins ade according to the present invention, as set forth below.

FIG. 1 is a perspective view of a self-retained slider contact pin 12. The contact pin 12 preferably has three separate components: a first contact 14, a second contact 16, and a bias spring 18. The first contact 14 and the second contact 16 are configured to slidably fit together and interlock in a telescoping arrangement such that the overall combined length of the first contact 14 and the second contact 16 will expand and contract. The bias spring 18 is secured to engage between the first contact 14 and the second contact 16 to urge the first contact 14 and the second contact 16 to move apart, extending the overall combined length and providing compliance for electrically connecting between circuit conductors. Preferably the bias spring 18 is provided by a coil spring which is captured between tabs 28 and 30 of respective ones of the first contact 14 and the second contact 16. The tab 28 has a shoulder 32 and the tab 30 has a shoulder 34 which engage against opposite terminal ends of the bias spring 18. The respective end tips of the first contact pin 14 and the second contact pin 16 are provided by protuberances 20 and 22.

Figure 2:
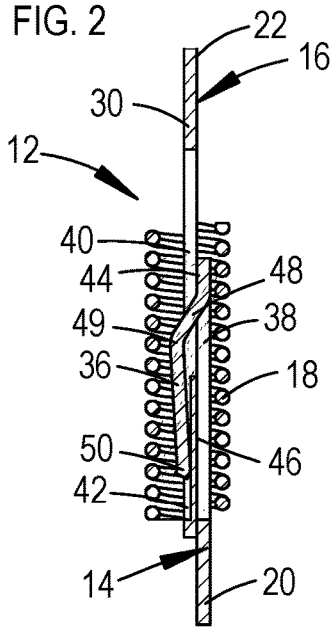
Figure 3:
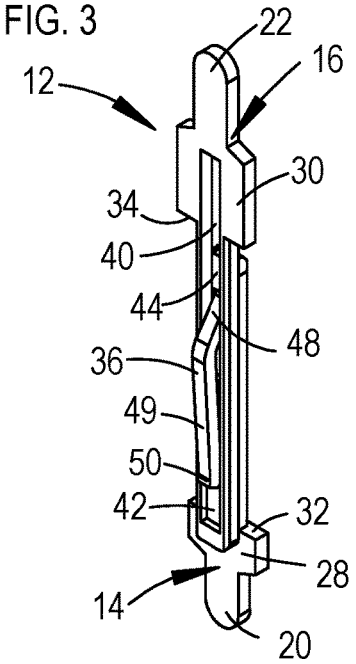
Figure 4:
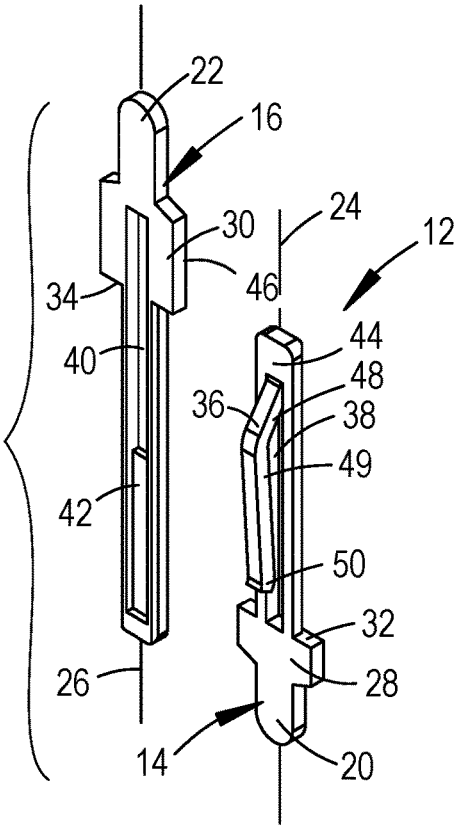

FIGS. 2-4 are views of the self-retained slider contact pin 12, in which FIG. 2 is a sectional view taken along section line 2-2 of FIG. 1, FIG. 3 is a perspective view of the self-retained slider contact pin 12 with the bias spring 18 removed, and FIG. 4 is an exploded view of the first contact 14 separated from the second contact 16. The first contact 14 and the second contact 16 of the slider contact pin 12 are slidably interlocked in the telescoping arrangement by means of a finger 36 which extends from the first contact 12 through an opening 40 in the second contact 16. The first contact 14 and the second contact 16 are each formed of respective strips of conductive material which preferably are formed by coining, or stamping, to have a length, a width and a thickness. Preferably the length is longer than the width is wide, and the thickness is nominal as compared to the width by an order of magnitude of at least four times the width. However, although length is generally thought of longer than width it may be determined in the opposite order in some circumstances contemplated by the present disclosure. The first contact 14 and the second contact 16 have widths defining flat surfaces 44 and 46, respectively, which will slidably engage in electrical contact providing mating surface areas with electric continuity between the contacts 14 and 16.

The first contact 14 is stamped from a strip of conductive material which preferably has an elongate body with a longitudinal axis 24, forming a notch 38 where the finger 36 is pressed from the width of the strip of conductive material. The finger 36 is preferably an elongate section of conductive material having compliance which is stamped from the strip of material and extends with first a base 48, then an intermediate section 49, and then a terminal end tip 50. The second contact 16 is coined from a second strip of conductive material preferably having an elongate body with a longitudinal axis 26. An opening 40 is stamped into the second contact 16 and provides a window for passing the finger 36 through the second contact 16. A channel 42 is also stamped into the second contact, preferably adjacent to the opening 40. The channel 42 provides a guide for receiving a terminal end tip 50 of the finger 36 and guiding the terminal end tip 50 of the finger 36 as the first contact 14 and the second contact 16 slidably move relative to one another. The base 48 of the finger 36 will generally be disposed within and engage the edges of the opening 40 in the second contact 16, which together with the compliance of the terminal end tip 50 engaging with the channel 42 provide that the first contact 14 and the second contact are self-retaining when assembled with the bias spring 18.

Figure 5:
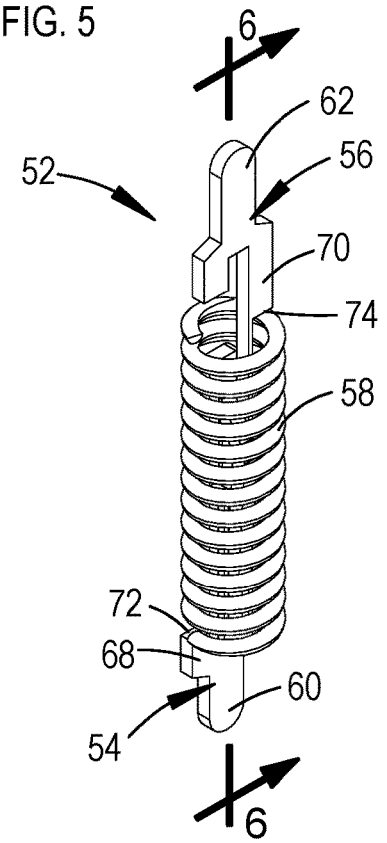

FIG. 5 is a perspective view of a second self-retained slider contact pin 52. The contact pin 54 preferably has three separate components: a first contact 54, a second contact 56, and a bias spring 58. The first contact 54 and the second contact 56 are configured to slidably fit together and interlock in a telescoping arrangement such that the overall combined length of the first contact 54 and the second contact 56 will expand and contract. The bias spring 58 is secured to engage between the first contact 54 and the second contact 56 to urge the first contact 54 and the second contact 56 to move apart, extending the overall combined length and providing compliance for electrically connecting between circuit conductors. Preferably the bias spring 58 is provided by a coil spring which is captured between tabs 68 and 70 of respective ones of the first contact 54 and the second contact 56. The tab 68 has a shoulder 72 and the tab 70 has a shoulder 74 which engage against opposite terminal ends of the bias spring 58. The respective end tips of the first contact pin 54 and the second contact pin 56 are provided by protuberances 20 and 22.

Figure 6:
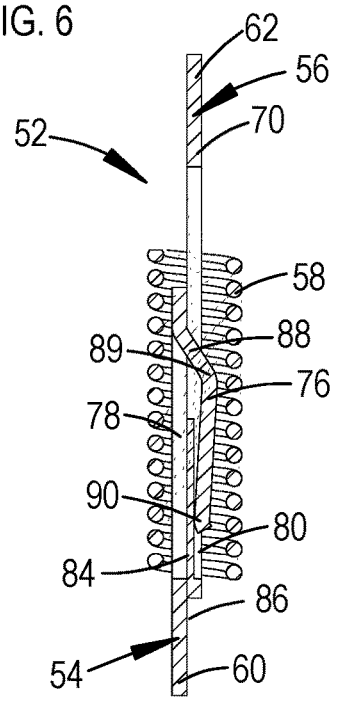
Figure 7:
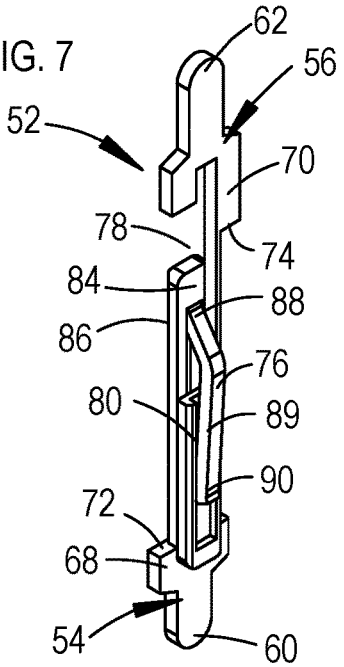
Figure 8:
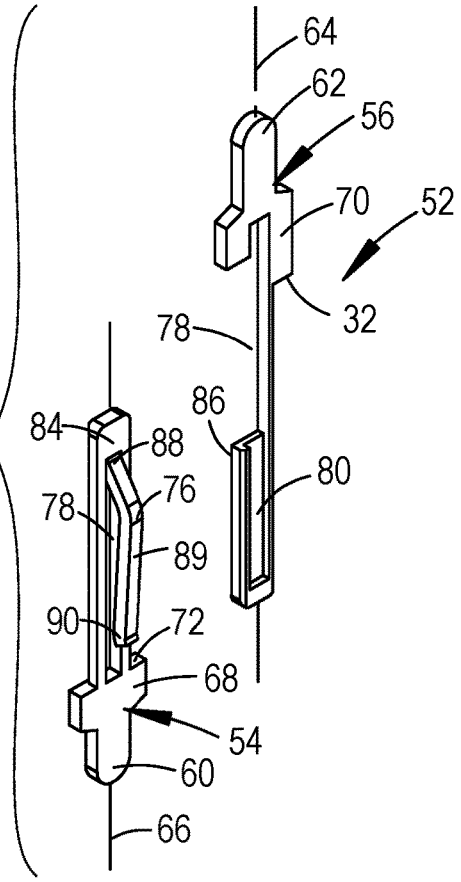

FIGS. 6-8 are views of the self-retained slider contact pin 52, in which FIG. 6 is a sectional view taken along section line 6-6 of FIG. 5, FIG. 7 is a perspective view of the self-retained slider contact pin 52 with the bias spring 58 removed, and FIG. 8 is an exploded view of the first contact 54 separated from the second contact 56. The first contact 54 and the second contact 56 of the slider contact pin 52 are slidably interlocked in the telescoping arrangement by means of a finger 76 which extends from the first contact 52 through an opening 80 in the second contact 56. The first contact 54 and the second contact 56 are each formed of respective strips of conductive material which preferably are formed by coining, or stamping, to have a length, a width and a thickness. Preferably the length is longer than the width is wide, and the thickness is nominal as compared to the width by an order of magnitude of at least four times the width. However, although length is generally thought of longer than width it may be determined in the opposite order in some circumstances contemplated by the present disclosure.

The first contact 54 is stamped from a strip of conductive material which preferably has an elongate body with a longitudinal axis 64, forming a notch 78 where the finger 76 is pressed from the width of the strip of conductive material. The finger 76 is preferably an elongate section of conductive material having compliance which is stamped from the strip of material and extends with first a base 88, then an intermediate section 89, and then a terminal end tip 90. The second contact 56 is coined from a second strip of conductive material preferably having an elongate body with a longitudinal axis 66. An opening 80 is stamped into the second contact 56 and provides a window for passing the finger 76 through the second contact 56. A channel 82 is also stamped into the second contact, preferably adjacent to the opening 80. The channel 82 provides a guide for receiving a terminal end tip 90 of the finger 76 and guiding the terminal end tip 90 of the finger 76 as the first contact 54 and the second contact 56 slidably move relative to one another. The base 88 of the finger 76 will generally be disposed within and engage the edges of the opening 80 in the second contact 56, which together with the compliance of the terminal end tip 90 engaging with the channel 82 provide that the first contact 54 and the second contact are self-retaining when assembled with the bias spring 58. The first contact 54 and the second contact 56 have widths defining flat surfaces 84 and 96, respectively, which will slidably engage in electrical contact providing mating surface areas with electric continuity between the contacts 54 and 56.

Figure 9:
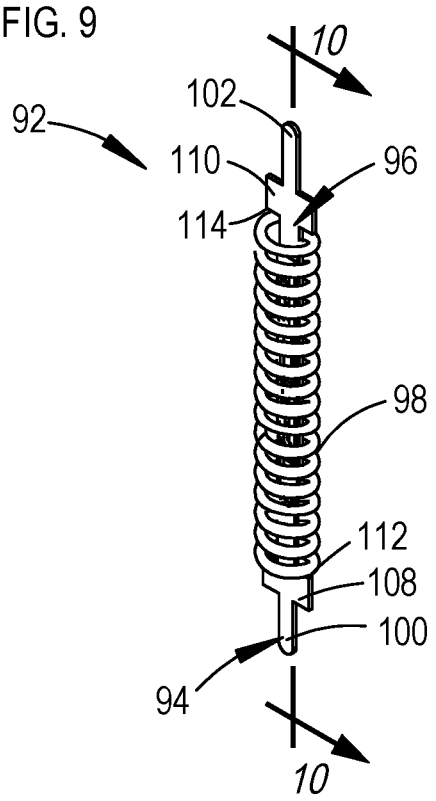

FIG. 9 is a perspective view of a third self-retained slider contact pin 92. The third contact pin 92 preferably has three separate components: a first contact 94, a second contact 96, and a bias spring 98. The first contact 94 and the second contact 96 are configured to slidably fit together and interlock in a telescoping arrangement such that the overall combined length of the first contact 94 and the second contact 96 will expand and contract. The bias spring 98 is secured to engage between the first contact 94 and the second contact 96 to urge the first contact 94 and the second contact 96 to move apart, extending the overall combined length and providing compliance for electrically connecting between circuit conductors. Preferably the bias spring 98 is provided by a coil spring which is captured between tabs 108 and 110 of respective ones of the first contact 94 and the second contact 96. The tab 98 has a shoulder 112 and the tab 100 has a shoulder 114 which engage against opposite terminal ends of the bias spring 98. The respective end tips of the first contact pin 94 and the second contact pin 96 are provided by protuberances 100 and 102.

Figure 10:
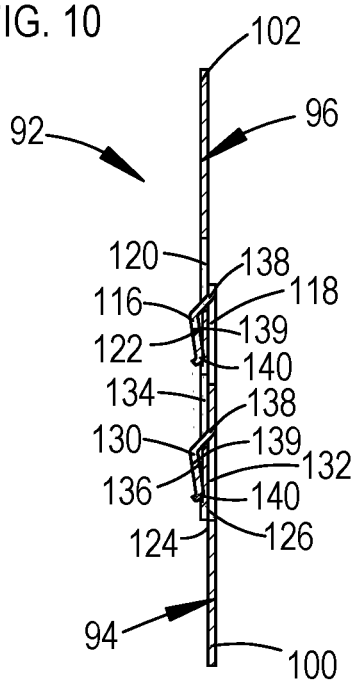
Figure 11:
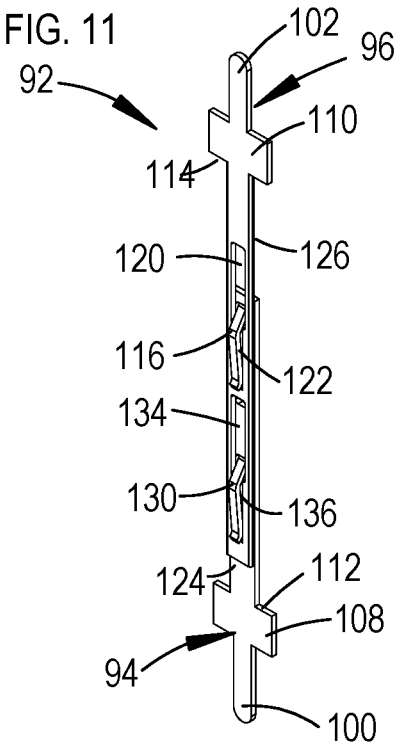
Figure 12:
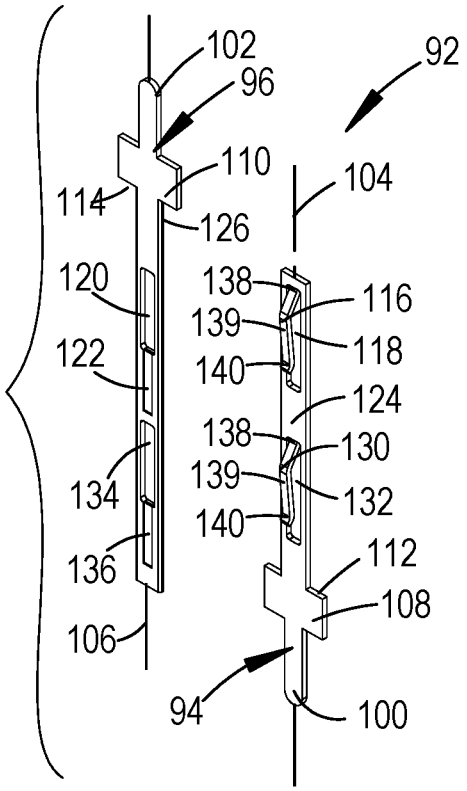

FIGS. 10-12 are views of the self-retained slider contact pin 92, in which FIG. 10 is a sectional view taken along section line 10-10 of FIG. 9, FIG. 11 is a perspective view of the self-retained slider contact pin 92 with the bias spring 98 removed, and a FIG. 12 is an exploded view of the first contact 94 separated from the second contact 16. The first contact 94 and the second contact 96 of the slider contact pin 92 are slidably interlocked in the telescoping arrangement by means of two longitudinally spaced apart fingers 116 and 130 which extend from the first contact 92 through respective openings 120 and 134 in the second contact 96. The fingers 116 and 130 are preferably configured to align in registration with the openings 120 and 134. The first contact 94 and the second contact 96 are each formed of respective strips of conductive material which preferably are formed by coining, or stamping, to have a length, a width and a thickness. Preferably the length is longer than the width is wide, and the thickness is nominal as compared to the width by an order of magnitude of at least four times the width. However, although length is generally thought of longer than width it may be determined in the opposite order in some circumstances contemplated by the present disclosure. The first contact 94 and the second contact 96 have widths defining flat surfaces 124 and 126, respectively, which will slidably engage in electrical contact providing mating surface areas with electric continuity between the contacts 94 and 96.

The first contact 94 is stamped from a strip of conductive material which preferably has an elongate body with a longitudinal axis 104, forming a notch 118 and a notch 132 where the finger 116 and the finger 130, respectively, are stamped from the width of the strip of conductive material. The finger 116 and the finger 130 are each preferably formed of an elongate section of conductive material having compliance which are stamped from the strip of material and each extend with first a base 138, then an intermediate section 139, and then a terminal end tip 140. The second contact 96 is coined from a second strip of conductive material preferably having an elongate body with a longitudinal axis 106. An opening 120 and an opening 134 are stamped into the second contact 96, spaced apart along the longitudinal axis 106. The openings 120 and 134 provide two spaced apart windows for passing respective ones of the fingers 116 and 130 through the second contact 96. The channels 122 and 136 are also stamped into the second contact 96, preferably adjacent to respective ones of the openings 120 and 134. The channels 122 and 136 provide guides for receiving the terminal end tips 140 of the fingers 116 and 130 and guiding the terminal end tips 140 of the fingers 116, 130 as the first contact 94 and the second contact 96 slidably move relative to one another. The base 138 of the fingers 116 and 130 will generally be disposed within and engage the edges of respective ones of the openings 120 and 134 in the second contact 96, which together with the compliance of the terminal end tips 140 engaging with respective ones of the channels 122 and 136 provide that the first contact 94 and the second contact 96 are self-retaining when assembled with the bias spring 98. As compared to contact pins with only one finger, the two fingers 116 and 130 of the third contact pin 92 are spaced apart along the longitudinal axes 104, 106 to further secure the first contact 94 and the second contact 96 against relative rotation about an axis extending perpendicular to the preferably parallel longitudinal axes 104, 106.

Figure 13:
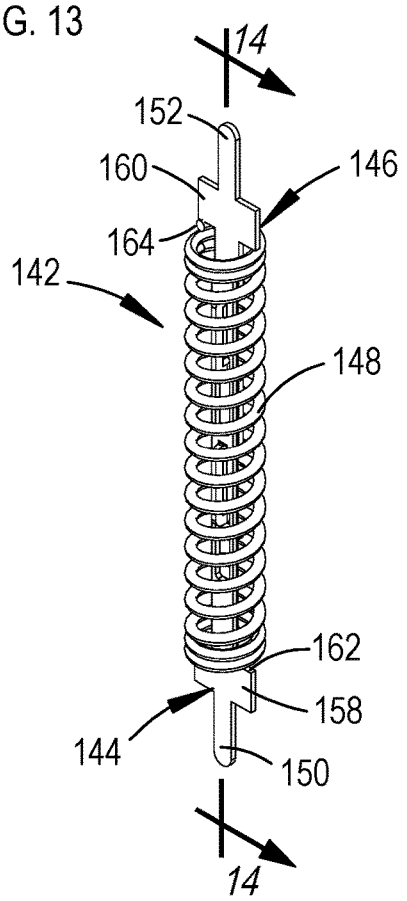

FIG. 13 is a perspective view of a fourth self-retained slider contact pin 142. The contact pin 142 preferably has three separate components: the first contact 144, a second contact 146, and a bias spring 148. The first contact 144 and the second contact 146 are configured to slidably fit together and interlock in a telescoping arrangement such that the overall combined length of the first contact 144 and the second contact 146 will expand and contract. The bias spring 148 is secured to engage between the first contact 144 and the second contact 146 to urge the first contact 144 and the second contact 146 to move apart, extending the overall combined length and providing compliance for electrically connecting between circuit conductors. Preferably the bias spring 148 is provided by a coil spring which is captured between tabs 158 and 160 of respective ones of the first contact 144 and the second contact 146. The tab 158 has a shoulder 162 and the tab 160 has a shoulder 164 which engage against opposite terminal ends of the bias spring 148. The respective end tips of the first contact pin 144 and the second contact pin 146 are provided by protuberances 150 and 152.

Figure 14:
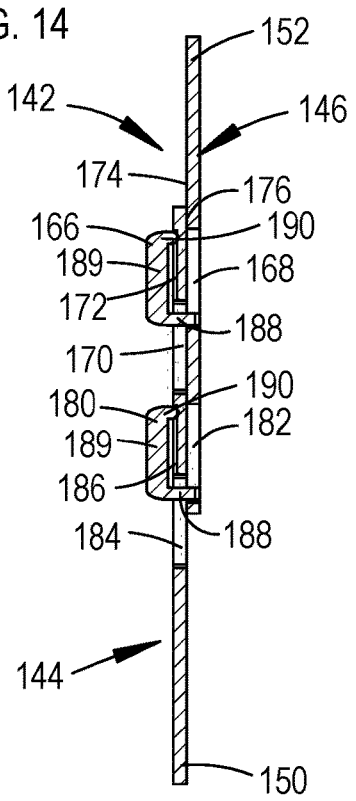
Figure 15:
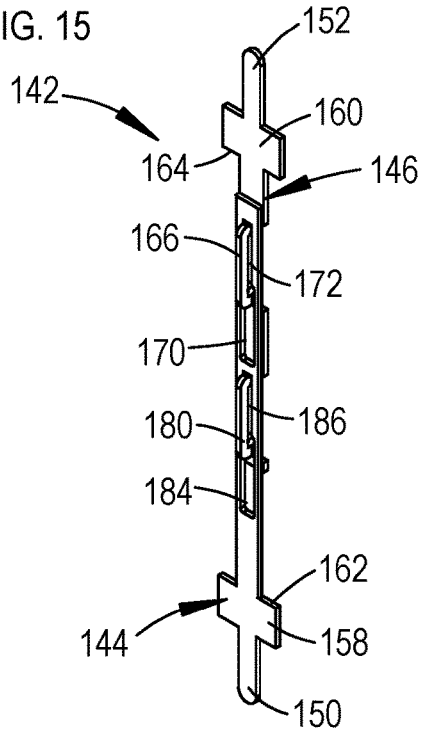
Figure 16:
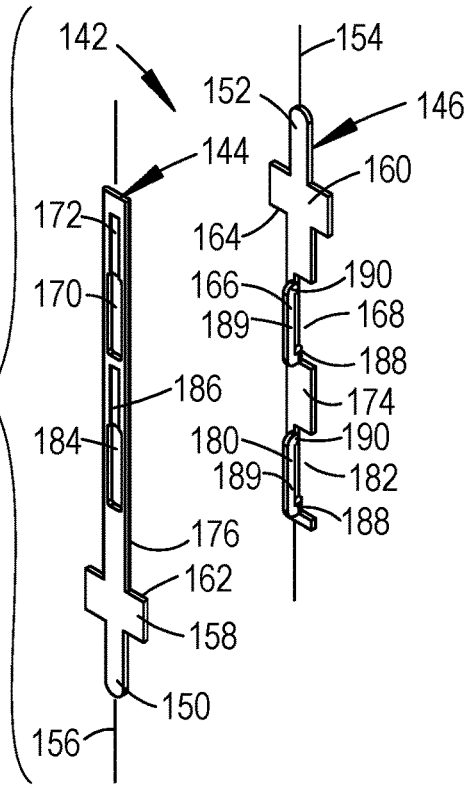

FIGS. 14-16 are views of the self-retained slider contact pin 142, in which FIG. 14 is a sectional view taken along section line 14-14 of FIG. 13, FIG. 15 is a perspective view of the self-retained slider contact pin 142 with the bias spring 148 removed, and FIG. 16 is an exploded view of the first contact 144 separated from the second contact 146. The first contact 144 and the second contact 146 of the slider contact pin 142 are slidably interlocked in the telescoping arrangement by means of two longitudinally spaced apart fingers 166 and 180 which extend from the first contact 142 through respective openings 170 and 184 in the second contact 146. The fingers 166 and 180 are preferably configured to align in registration with the openings 170 and 184. The first contact 144 and the second contact 146 are each formed of respective strips of conductive material which preferably are formed by coining, or stamping, to have a length, a width and a thickness. Preferably the length is longer than the width is wide, and the thickness is nominal as compared to the width by an order of magnitude of at least four times the width. However, although length is generally thought of longer than width it may be determined in the opposite order in some circumstances contemplated by the present disclosure. The first contact 94 and the second contact 146 have widths defining flat surfaces 174 and 176, respectively, which will slidably engage in electrical contact providing mating surface areas with electric continuity between the contacts 144 and 146.

The first contact 144 is stamped from a strip of conductive material which preferably has an elongate body with a longitudinal axis 154, forming a notch 168 and a notch 182 where the finger 166 and the finger 180, respectively, are stamped from the width of the strip of conductive material. The finger 166 and the finger 180 are each preferably formed of an elongate section of conductive material having compliance which are stamped from the strip of material and each extend with first a base 188, then an intermediate section 189, and then a terminal end tip 190. The second contact 146 is coined from a second strip of conductive material preferably having an elongate body with a longitudinal axis 156. An opening 170 and an opening 184 are stamped into the second contact 146, spaced apart along the longitudinal axis 156. The openings 170 and 184 provide two spaced apart windows for passing respective ones of the fingers 166 and 180 through the second contact 146. The channels 172 and 186 are also stamped into the second contact 146, preferably adjacent to respective ones of the openings 170 and 184. The channels 172 and 186 provide guides for receiving terminal end tips 190 of the fingers 166 and 180 and guiding the terminal end tips 190 of the fingers 166, 180 as the first contact 144 and the second contact 146 slidably move relative to one another. The base 188 of the fingers 166 and 180 will generally be disposed within and engage the edges of respective ones of the openings 170 and 184 in the second contact 146, which together with the compliance of the terminal end tips 190 engaging with respective ones of the channels 172 and 186 provide that the first contact 144 and the second contact 146 are self-retaining when assembled with the bias spring 148. As compared to contact pins with only one finger, the two fingers 166 and 180 of the fourth contact pin 142 are spaced apart along the longitudinal axes 154, 156 to further secure the first contact 144 and the second contact 146 against relative rotation about an axis extending perpendicular to the preferably parallel longitudinal axes 154, 166.

Figure 17:
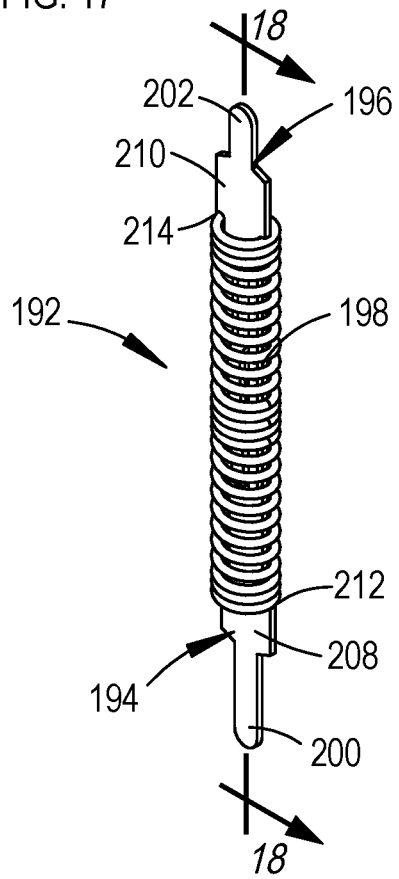

FIG. 17 is a perspective view of a fifth self-retained slider contact pin 192. The contact pin 192 preferably has three separate components: the first contact 194, a second contact 196, and a bias spring 198. The first contact 194 and the second contact 196 are configured to slidably fit together and interlock in a telescoping arrangement such that the overall combined length of the first contact 194 and the second contact 196 will expand and contract. The bias spring 198 is secured to engage between the first contact 194 and the second contact 196 to urge the first contact 194 and the second contact 196 to move apart, extending the overall combined length and providing compliance for electrically connecting between circuit conductors. Preferably the bias spring 198 is provided by a coil spring which is captured between tabs 208 and 210 of respective ones of the first contact 194 and the second contact 196. The tab 208 has a shoulder 212 and the tab 210 has a shoulder 214 which engage against opposite terminal ends of the bias spring 198. The respective end tips of the first contact pin 194 and the second contact pin 196 are provided by protuberances 200 and 202.

Figure 18:
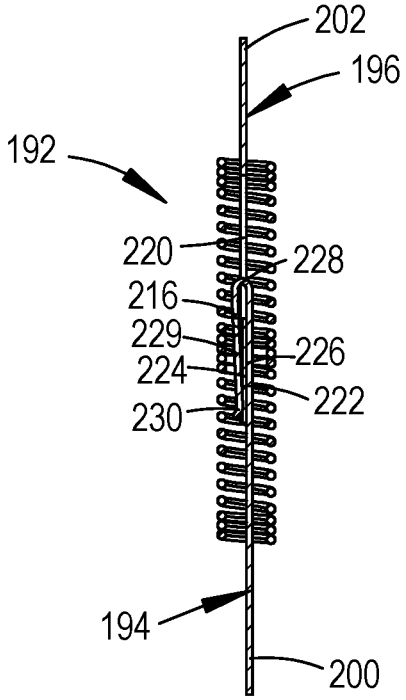
Figure 19:
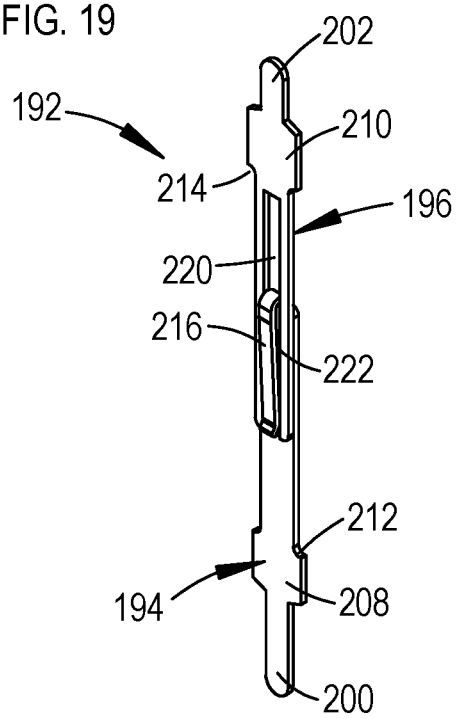
Figure 20:
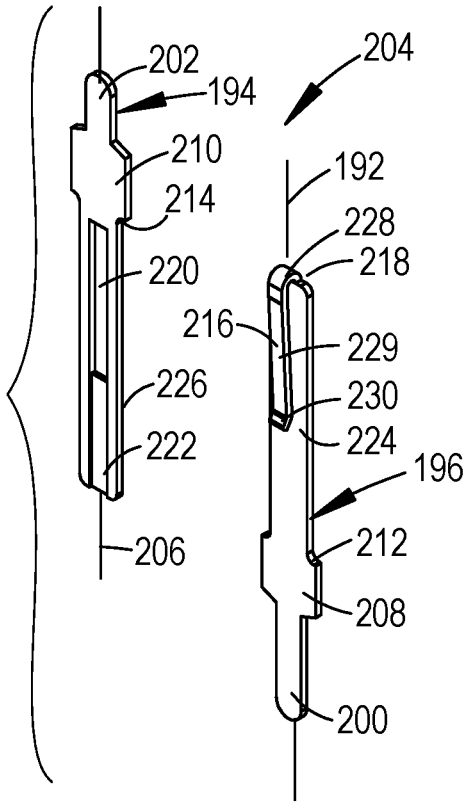

FIGS. 18-20 are views of the self-retained slider contact pin 192, in which FIG. 18 is a sectional view taken along section line 18-18 of FIG. 17, FIG. 19 is a perspective view of the self-retained slider contact pin 192 with the bias spring 198 removed, and FIG. 20 is an exploded view of the first contact 194 separated from the second contact 196. The first contact 194 and the second contact 196 of the slider contact pin 192 are slidably interlocked in the telescoping arrangement by means of a finger 216 which extends from a terminal end of the first contact 192, and through an opening 220 in the second contact 196. The first contact 194 and the second contact 196 are each formed of respective strips of conductive material which preferably are formed by coining, or stamping, to have a length, a width and a thickness. Preferably the length is longer than the width is wide, and the thickness is nominal as compared to the width by an order of magnitude of at least four times the width. However, although length is generally thought of longer than width it may be determined in the opposite order in some circumstances contemplated by the present disclosure. The first contact 194 and the second contact 196 have widths defining flat surfaces 224 and 226, respectively, which will slidably engage in electrical contact providing mating surface areas with electric continuity between the contacts 194 and 196.

The first contact 194 is stamped from a strip of conductive material which preferably has an elongate body with a longitudinal axis 204, forming a notch 218 where the finger 216 is pressed from the width of the strip of conductive material, rolled from a longitudinal edge of the first contact 194. The finger 216 is preferably an elongate section of conductive material having compliance which is stamped and then rolled from an edge of the strip of material and extends with first a base 228, then an intermediate section 229, and then a terminal end tip 230. The second contact 196 is coined from a second strip of conductive material preferably having an elongate body with a longitudinal axis 206. An opening 220 is stamped into the second contact 196 and provides a window for passing the finger 216 through the second contact 196. A channel 222 is also stamped into the second contact, preferably adjacent to the opening 220. The channel 222 provides a guide for receiving a terminal end tip 230 of the finger 216 and guiding the terminal end tip 230 of the finger 26 as the first contact 194 and the second contact 196 slidably move relative to one another. The base 228 of the finger 216 will generally be disposed within and engage the edges of the opening 210 in the second contact 196, which together with the compliance of the terminal end tip 230 engaging with the channel 222 provide that the first contact 194 and the second contact 196 are self-retaining when assembled with the bias spring 198.

The present disclosure provides advantages of compliant contact pin which is formed of coined or stamped contacts. The contact pin is self-retaining and provides slidably engaged contact areas between the first contact and the second contact. Two contact members are secured together by one or more fingers which are stamped from the contact members and extend through windows formed into the other contact member. The two contact members engage in a surface area contact. A bias spring urges compliance with mating parts.

Although the preferred embodiment has been described in detail, it should be understood that various changes, substitutions and alterations can be made therein without departing from the spirit and scope of the invention as defined by the appended claims.

What is claimed is:

1. A self-retained slider contact pin for providing compliant electrical contact between electric circuits comprising:

a first contact having a first elongate body formed of a first flat strip of conductive material having a first length, a first width and a first nominal thickness as compared to said first length and said first width, wherein said first width of said first flat strip is coined to form both a first notch and a first finger from said first notch, with said first finger having a first finger length extending in a longitudinal direction, spaced apart from and generally parallel to said first notch;

a second contact having a second elongate body formed of a second flat strip of conductive material having a second length, a second width and a second nominal thickness as compared to said second length and said second width, wherein said second width of said second flat strip is coined to form both an opening and a first channel, with said first channel disposed adjacent to and longitudinally aligned with said opening;

wherein said first contact and said second contact are adapted for inter-fitting in parallel alignment, said first width facing said second width, with said first finger extending through said opening and into said first channel; and a bias spring (coil spring) having one end engaging said first contact and a second end engaging said second contact for pushing said first contact and said second contact in opposite longitudinal directions with said first finger engaging said second member from within said opening and within said first channel to prevent said first contact and said second contact from separating, with said second width captured between said first finger and said second width.

2. The self-retained slider contact pin according to claim 1, wherein said first contact and said second contact each include laterally extending stops which extend in directions substantially transverse to respective ones of said first length and said second length, with said stops being spaced apart for respectively engaging with opposite ends of said bias spring to urge said first contact and said second contact to push apart.

3. The self-retained slider contact pin according to claim 1, wherein said first contact and said second contact each have longitudinally extending protrusions defined on terminal ends thereof and facing in opposite directions, and adapted for electrically engaging adjacent circuit contacts.

4. The self-retained slider contact pin according to claim 1, wherein portions of said first width and said second width remain in intimate contact with electrical continuity therebetween, wherein said finger is adapted for retaining said second width of said second contact in conductive engagement with said first width of said first contact.

5. The self-retained contact pin according to claim 1, further comprising:

said first width of said first flat strip of said first contact being coined to further form a second notch and a second finger from said second notch, with said second finger having a second finger length extending in said longitudinal direction, spaced apart and generally parallel to said second notch, and wherein said second notch and said second finger as spaced part from said first notch said first finger;

said second width of said second flat strip of a second contact being coined to further form both a second opening and a second channel, with said second channel disposed adjacent to and longitudinally aligned with said second opening, and wherein said second opening and said second channel are spaced apart from said first opening and said first channel; and wherein said first contact and said second contact are adapted for inter-fitting in parallel alignment, with said second finger extending through said second opening and into said second channel with said second finger engaging said second member from within said second opening and within said second channel to further prevent said first contact and said second contact from separating, with said second width captured between said second finger and said second width.

6. The self-retained contact pin according to claim 5, wherein said second notch and said second finger, are spaced apart from said first notch and second first finger in said longitudinal direction, and said second opening and said second channel are spaced apart from said first opening in said longitudinal direction, such that said first finger and said second finger are adapted for together capturing said second width of said second contact and retaining said first contact in conductive engagement with said second contact.

7. The self-retained slider contact pin according to claim 5, wherein said first contact and said second contact each include laterally extending stops which extend in directions substantially transverse to respective ones of said first length and said second length, with said stops being spaced apart for respectively engaging with opposite ends of said bias spring to urge said first contact and said second contact to push apart.

8. The self-retained slider contact pin according to claim 5, wherein said first contact and said second contact each have longitudinally extending protrusions defined on terminal ends thereof and facing in opposite directions from an other of said protrusions, and adapted for electrically engaging adjacent circuit contacts.

9. A self-retained slider contact pin for providing compliant electrical contact between electric circuits comprising:

a first contact having a first elongate body formed of a first flat strip of conductive material having a first length, a first width and a first nominal thickness as compared to said first length and said first width, wherein said first width of said first flat strip is coined to form both a first notch and a first finger from said first notch, and both a second notch and a second finger from said second notch, wherein said first finger and said second finger extend in a longitudinal direction relative to said first contact, spaced apart from and generally parallel to said first notch and said second notch, respectively;

a second contact having a second elongate body formed of a second flat strip of conductive material having a second length, a second width and a second nominal thickness as compared to said second length and said second width, wherein said second width of said second flat strip is coined to form both an opening and a first channel, and both a second opening and a second channel, wherein said first channel is longitudinally aligned with said opening and said second channel disposed in longitudinal alignment with said second opening, and wherein said second opening and said second channel are spaced apart from said first opening and said first channel;

wherein said first contact and said second contact are adapted for inter-fitting in parallel longitudinal alignment, with said first width facing said second width, said first finger extending through said opening and into said first channel engaging said second member from within said first opening and said second finger extending through said second opening and into said second channel and engaging said second member from within said second opening, such that both said first finger and said second finger retain from separating said first contact and said second contact, with said first contact and second contact in both conductive sliding engagement; and a bias spring having one end engaging said first contact and a second end engaging said second contact for pushing said first contact and said second contact in opposite longitudinal directions.

10. The self-retained slider contact pin according to claim 9, wherein said first contact and said second contact each include laterally extending stops which extend in directions substantially transverse to respective ones of said first length and said second length, with said stops being spaced apart for respectively engaging with opposite ends of said bias spring to urge said first contact and said second contact to push apart.

11. The self-retained slider contact pin according to claim 9, wherein said first contact and said second contact each have longitudinally extending protrusions defined on terminal ends thereof and facing in opposite directions, and adapted for electrically engaging adjacent circuit contacts.

12. The self-retained slider contact pin according to claim 9, wherein portions of said first width and said second width remain in intimate contact with electrical continuity therebetween, wherein said first finger and said second finger are adapted for retaining said second width of said second contact in conductive engagement with said first width of said first contact.

13. The self-retained contact pin according to claim 12, wherein said second notch and said second finger, are spaced apart from said first notch and second first finger in said longitudinal direction, and said second opening and said second channel are spaced apart from said first opening in said longitudinal direction, such that said first finger and said second finger are adapted for together capturing said second width of said second contact and retaining said first contact in conductive engagement with said second contact.

14. A self-retained slider contact pin for providing compliant electrical contact between electric circuits comprising:

a first contact having a first elongate body formed of a first flat strip of conductive material having a first length, a first width and a first nominal thickness as compared to said first length and said first width, wherein said first width of said first flat strip is coined to form both a first notch and a first finger from said first notch, and both a second notch and a second finger from said second notch, wherein said first finger and said second finger extend in a longitudinal direction relative to said first contact, spaced apart from and generally parallel to said first notch and said second notch, respectively;

a second contact having a second elongate body formed of a second flat strip of conductive material having a second length, a second width and a second nominal thickness as compared to said second length and said second width, wherein said second width of said second flat strip is coined to form both an opening and a first channel, and both a second opening and a second channel, wherein said first channel is longitudinally aligned with said opening and said second channel disposed in longitudinal alignment with said second opening, and wherein said second opening and said second channel are spaced apart from said first opening and said first channel;

wherein said first contact and said second contact are adapted for inter-fitting in parallel longitudinal alignment, with said first width facing said second width, said first finger extending through said opening and into said first channel engaging said second member from within said first opening and said second finger extending through said second opening and into said second channel and engaging said second member from within said second opening, such that both said first finger and said second finger retain from separating said first contact and said second contact, with said first contact and second contact in both conductive sliding engagement;

wherein said second notch and said second finger, are spaced apart from said first notch and second first finger in said longitudinal direction, and said second opening and said second channel are spaced apart from said first opening in said longitudinal direction, such that said first finger and said second finger are adapted for together capturing said second width of said second contact and retaining said first contact in intimate contact with said second contact, with electrical continuity there-between; and a coil spring having one end engaging said first contact and a second end engaging said second contact for pushing said first contact and said second contact in opposite longitudinal directions.

15. The self-retained slider contact pin according to claim 14, wherein said first contact and said second contact each include laterally extending tabs which extend in directions substantially transverse to respective ones of said first length and said second length, with said tabs providing stops which are disposed on opposite ones of said first contact and said second contact, respectively, and spaced apart for engaging with opposite ends of said bias spring to urge said first contact and said second contact to push apart.

16. The self-retained slider contact pin according to claim 14, wherein said first contact and said second contact each have longitudinally extending protrusions defined on terminal ends thereof and facing in opposite directions, and adapted for electrically engaging adjacent circuit contacts.

* * * * *